United States Patent [19]

Beamenderfer et al.

[11] Patent Number: 4,834,674

[45] Date of Patent: May 30, 1989

[54] ELECTRICAL CABLE ASSEMBLY WITH SELECTED SIDE CABLE ENTRY

[75] Inventors: Robert E. Beamenderfer, Palmyra; Larry E. Conley, York; Charles A. Miller, York New Salem; Warren D. Nauman, Elizabethtown; Ronald S. Pala, Mechanicsburg; William E. Zelko, Dauphin, all of Pa.

[73] Assignee: AMP Incorporated, Harrisburg, Pa.

[21] Appl. No.: 210,685

[22] Filed: Jun. 23, 1988

[51] Int. Cl.[4] ..... H01R 13/04

[52] U.S. Cl. ..... 439/494

[58] Field of Search ..... 439/389–418, 439/422–424, 492–499

[56] References Cited

U.S. PATENT DOCUMENTS

| | | | |
|---|---|---|---|
| 3,004,237 | 10/1961 | Cole et al. | 439/494 |
| 3,573,719 | 4/1971 | Lightner | 439/494 |
| 3,634,806 | 1/1972 | Fergusson | 439/494 |
| 4,040,704 | 8/1977 | Huber . | |
| 4,094,566 | 6/1978 | Dola et al. . | |
| 4,140,360 | 2/1979 | Huber . | |
| 4,260,209 | 4/1981 | Zell et al. . | |
| 4,269,466 | 5/1981 | Huber . | |
| 4,279,074 | 7/1981 | Zell et al. . | |
| 4,602,830 | 7/1986 | Lockard . | |
| 4,602,831 | 7/1986 | Lockard . | |
| 4,655,515 | 4/1987 | Hamsher, Jr. et al. . | |
| 4,681,382 | 7/1987 | Lockard . | |
| 4,682,840 | 7/1987 | Lockard . | |
| 4,725,243 | 2/1988 | Pretchel et al. | 439/494 |
| 4,737,117 | 4/1988 | Lockard . | |

FOREIGN PATENT DOCUMENTS

| | | |
|---|---|---|
| 0072063 | 7/1982 | European Pat. Off. . |

*Primary Examiner*—Joseph H. McGlynn
*Attorney, Agent, or Firm*—Gerald K. Kita

[57] ABSTRACT

An electrical cable assembly 1 comprises, electrical contacts 9 mounted in an insulative housing 8, the contacts 9 are connected to signal wires 4 of an electrical cable 2, a ground bus 7 connected to ground wires 5 of the cable 2, the wires 4,5 are bent to extend toward a cable entry side 15 or 16 of the assembly 1, the ground bus 7 is connected by tabs 14 to selected contacts 9', and the tabs 14 offset the ground bus 7 to a side of the assembly 1.

9 Claims, 6 Drawing Sheets

ELECTRICAL CABLE ASSEMBLY WITH SELECTED SIDE CABLE ENTRY

FIELD OF THE INVENTION

The specification discloses an electrical cable assembly wherein signal wires of an electrical cable are connected to conductive electrical contacts and ground wires of the cable are connected to a ground bus.

BACKGROUND OF THE INVENTION

U.S. patent application No. 06/938,082, filed Nov. 28, 1986, European application No. 0072063, discloses a known electrical cable assembly comprising, an insulative housing, electrical contacts spaced apart along the housing, connecting portions of the contacts are in a first plane and form wire connections in the first plane with corresponding signal wires of the cable, connecting portions of a ground bus are in a second plane and form wire connections in the second plane with corresponding ground wires of the cable, one or more tabs connect the ground bus to corresponding selected contacts, and the longer of the wires extend from their wire connections toward a cable entry without intersecting the plane of the wire connections of the shorter wires.

In the known electrical cable assembly, the cable entry is one hundred eighty degrees from the front of the assembly. Thereby the assembly is known as a one hundred eighty degree cable assembly or a rear entry cable assembly. Another known electrical cable assembly is disclosed in U.S. Pat. No. 4,140,360, wherein the cable entry is ninety degrees from the front of the assembly. Thereby the assembly is known as a ninety degree cable assembly or a side entry cable assembly. Industry specifications require a side entry cable assembly that is capable of versatile construction such that the cable can enter either one side of the assembly or an opposite side of the assembly.

In the known rear entry cable assembly, the bus bar is along a side of the connector assembly and in the way of wires extending toward a cable entry along the same side. The wires would intersect the plane of the bus bar, and would be likely to engage the bus bar and incur undesired electrical shorting to the bus bar. Accordingly, the known rear entry cable assembly is not capable of construction such that the cable can enter either side of the assembly. The known rear entry cable assembly includes a cable strain relief at the rear of the connector. The strain relief increases to the length of the assembly, as measured from front to rear.

SUMMARY OF THE INVENTION

According to the invention, a cable assembly is of versatile construction that allows the cable to extend to a cable entry at either side of the assembly, without a loop in the cable.

In the known side entry cable assembly, the cable is extended to an alternate cable entry only by extending the cable to the rear of the ground bus and curving the cable to one side of the assembly. The length of the cable assembly from front to rear is increased when the cable is extended to the rear of the ground bus.

The known side entry cable assembly is not practical for a versatile construction that provides a cable entry at either side of the assembly by extending the ground bus offset correspondingly toward or away from a wire entry side of the cable.

According to the invention, an electrical cable assembly comprises; a cable wherein the wires of the cable extend to a cable entry side selected from one side of the housing or an opposite side of the housing, either the signal wires or the ground wires of the cable comprise longer wires of the cable, tabs project from corresponding contacts in a direction to offset the ground bus, either selectively toward the cable entry side or selectively away from the cable entry side, to position the wire connections of the longer wires laterally of the plane of the shorter wires and toward the cable entry side, so that the longer wires extend from their wire connections toward the selected cable entry side without intersecting the plane of the wire connections of the shorter wires.

The invention will be described by way of example in the following description that refers to the accompanying drawings.

DESCRIPTION OF THE DRAWINGS

FIG. 6 is a fragmentary elevation view in section of a cable assembly with a connector assembly at each end of the cable assembly.

Figure 1:
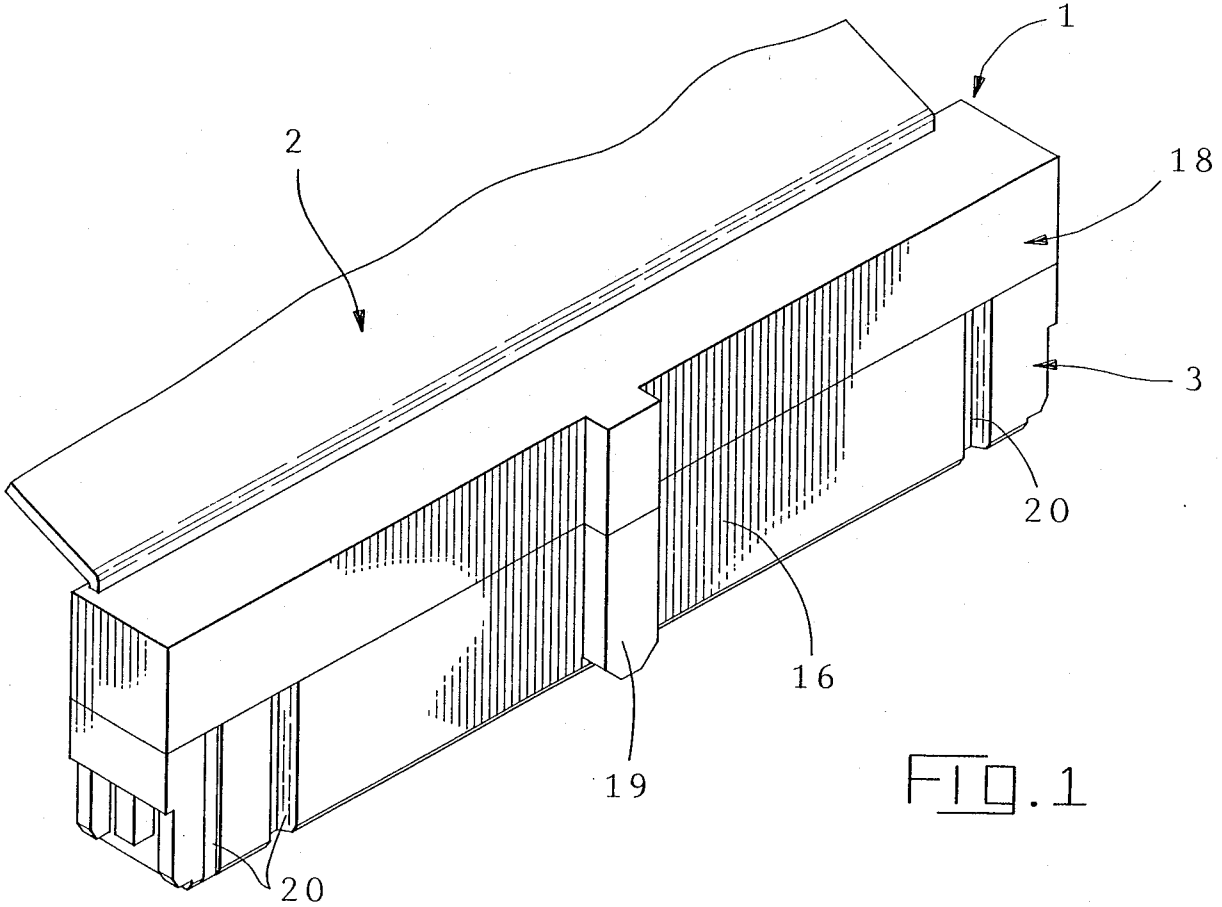
FIG. 1 is fragmentary perspective view of a connector assembly of a side entry cable assembly.

With further reference to the drawings, there is shown in FIGS. 1 and 6 an electrical cable 1 assembly of an electrical cable 2 connected at each of its ends with an electrical connector assembly 3. The cable 2 shown in FIG. 2 includes parallel elongated signal wires 4 spaced apart from each other on a pitch spacing, and parallel elongated ground wires 5, spaced apart from each other on a pitch spacing. The ground wires 5 are provided for connection to a reference electrical potential known collectively as ground potential. The signal wires 4 are provided for transmitting electrical signals, except for one or more of the signal wires 4 that are selected for connection to ground potential. The wires 4,5 are arranged in an order such that each signal wire 4 is between a pair of ground wires 5, the wires 4,5 are coplanar and spaced apart from each other and a planar and bendable jacket 6 of insulative material encircles each of the wires 4,5. The order of the wires 4,5 and their distances apart from each other, and the dielectric properties of the jacket 6 are unvaried along the length of the cable 2 such that a characteristic impedance of the cable 2 is maintained throughout its length.

Each electrical connector assembly 3 comprises, a conductive ground bus 7 for connection to corresponding ground wires 5 projecting from the cable jacket 6, an insulative housing 8, and conductive electrical contacts 9 having corresponding wire connecting portions 10 for connection to corresponding signal wires 5 projecting from the cable jacket 6.

The housing 8 includes a rigid plastic portion provided with two rows of axially elongated, contact receiving cavities 11 communicating with a front end 12 of the housing 8 and with a rear end 13 of the plastic portion.

The ground bus 7 is of unitary metal construction and provides conductive, spaced apart tabs 14 that are in a row and in a corresponding plane. The tabs 14 are spaced apart with a pitch spacing correspondingly the same as the pitch spacing of the spaced apart wire connecting portions 10 of the contacts 9.

Figure 2:
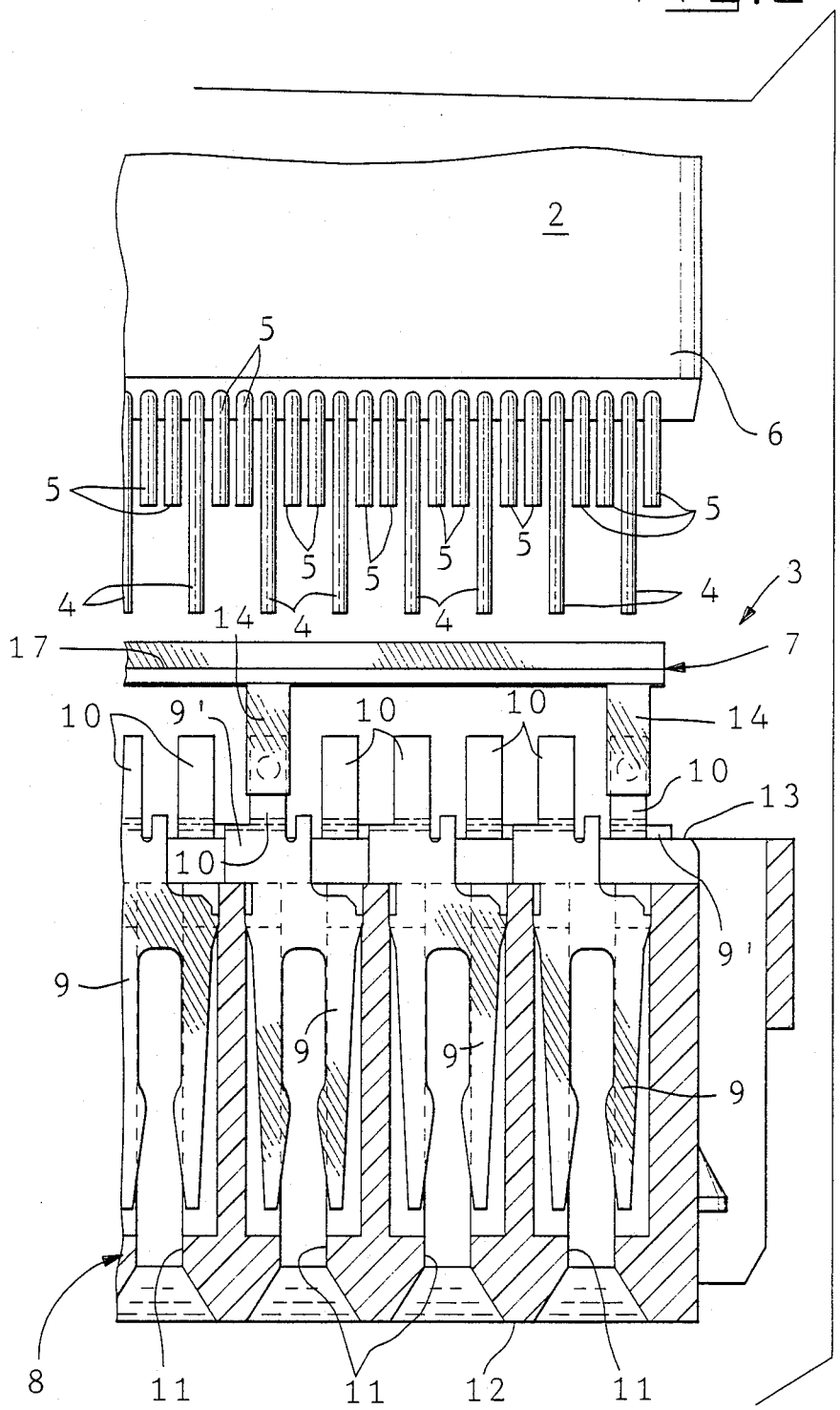
FIG. 2 is a fragmentary elevation in section of a portion of the connector assembly shown in FIG. 1 with parts exploded.
Figure 3:
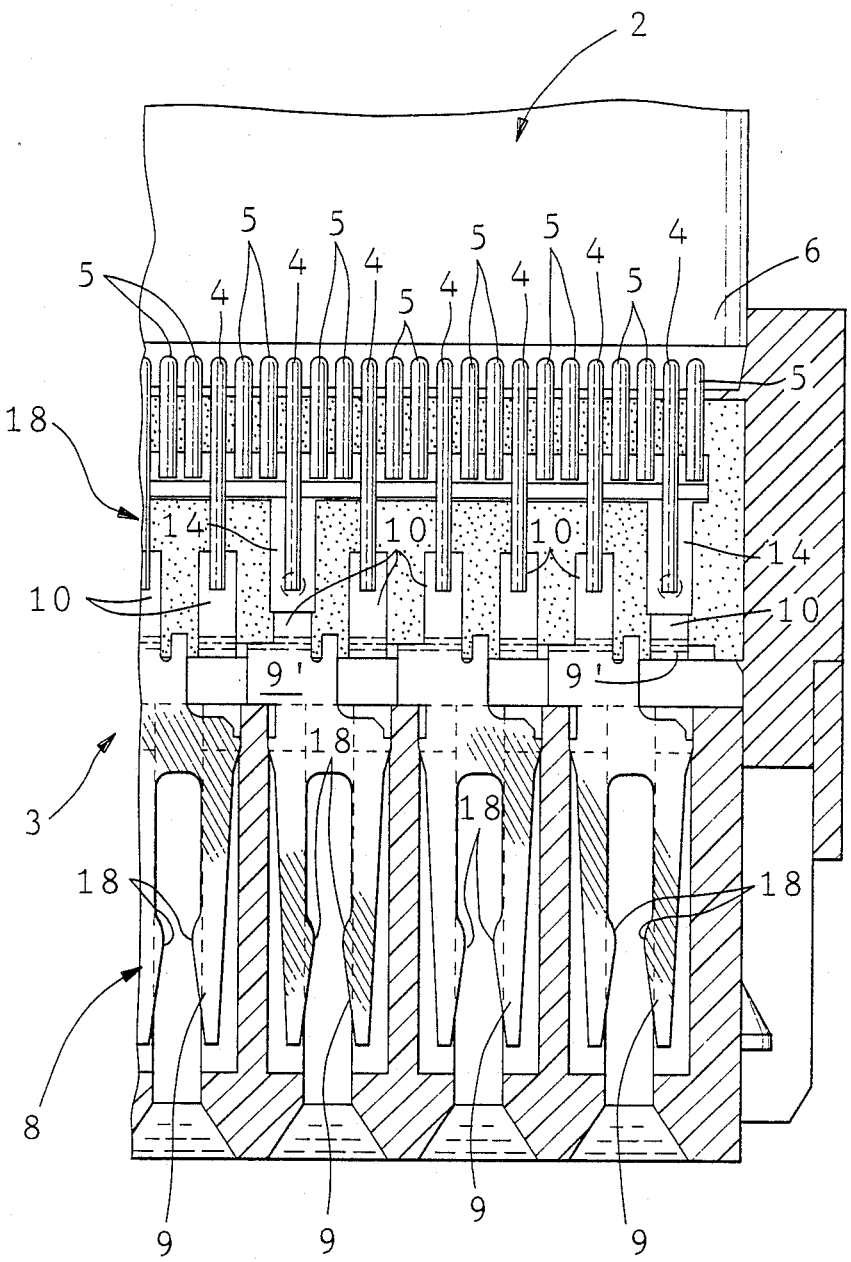
FIG. 3 is a view similar to FIG. 2, with parts shown assembled.
Figure 4:
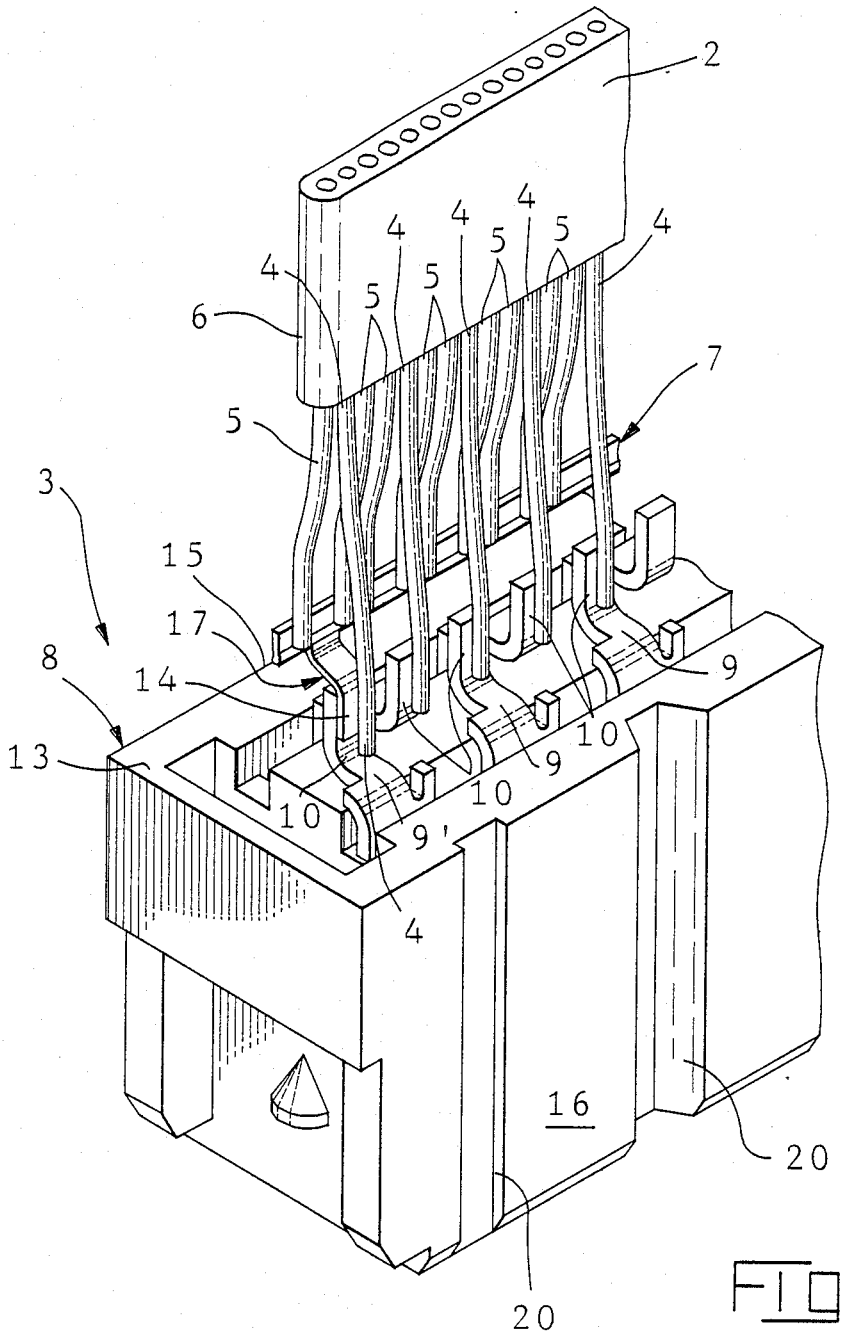
FIG. 4 is a fragmentary perspective view of the connector assembly shown in FIG. 3.

With reference to FIGS. 2, 3 and 4, assembly of the ground bus 7 in the connector assembly 3 will be described. The contacts 9 are assembled in corresponding cavities 11 of the housing 8. One or more of the contacts 9 are selected as ground contacts 9' to connect the ground bus 7 to ground potential. Selected tabs 14 are removed from the ground bus 7. Other selected tabs 14 that remain connected to the ground bus 7 are placed to overlie the wire connecting portions 10 of the ground contacts 9'. The tabs 14 are connected to the wire connecting portions 10 of the ground contacts 9', for example by welding or soldering, such that the ground contacts 9' are connected to the ground bus 7.

The wire connecting portions 10 of the contacts 9 have opposite sides that face toward corresponding opposite sides 15,16 of the connector assembly 3. The opposite sides of the wire connecting portions 10 are exposed to permit clamping of the wire connecting portions 10 between a pair of conventional electrodes, not shown, used for welding or soldering. Further the opposite sides of the wire connecting portions 10 are exposed to facilitate connection of a corresponding tab 14 selectively to one of the sides. The tabs 14 have an offset portion 17, FIG. 4, to offset the bus bar 7 toward one side 15 of the sides 15,16 of the connector assembly 3 and away from the plane of the wire connecting portions 10 of the contacts 9. The ground bus 7 can be assembled to be offset toward a second side 16 of the sides 15,16 of the connector assembly 3, provided that the tabs 14 on the bus bar 7 are correctly selected for alignment with the opposite sides of corresponding wire connecting portions 10 of the selected ground contacts 9'.

As shown in FIGS. 3 and 4, the ground bus 7 is of strip configuration. The strip configuration extends transversely of the housing 8 and provides wire connecting portions there along to which corresponding ground wires 5 are connected. To facilitate assembly of the ground wires 5 to the ground bus 7, the wire connecting portions of the ground bus 7 are in a row and are in a corresponding plane of the ground bus 7. Further, the wire connecting portions of the ground bus 7 are located with a pitch spacing correspondingly the same as the pitch spacing of the ground wires 5 of the cable 2. The ground wires 5 are cut to a common length, simultaneously overlaid upon the coplanar wire connecting portions of the ground bus 7 and connected to the wire connecting portions in one joining operation, for example, by welding or soldering. Wire connections of the ground wires 5 are formed by the joining operation.

Opposite sides of the wire connecting portions of the ground bus 7 are exposed, and thereby permit clamping of the wire connecting portions between a pair of conventional electrodes, not shown, to be used for welding or soldering the ground wires 5 to the ground bus 7.

As shown in FIG. 3, each contact 9 is of unitary construction and includes a pair of spaced apart fingers 18 defining an electrical receptacle portion open at a front end of the contact 9. The corresponding wire connecting portion 10 of each contact is in the form of an axially extending strip or tab projecting from the rear end 13 of the plastic portion. The wire connecting portions 10 of the contacts 9 are strips of narrow widths to achieve or approach impedance matching, whereby the impedance along the strips is the same as, or nearly the same as, the impedance of the cable 2 along the signal wires 4.

To facilitate assembly of the signal wires 4 to the contacts 9, the wire connecting portions 10 of the contacts 9 are arranged in an order wherein, the wire connecting portions 10 are in a row and are in a corresponding plane for connection to corresponding signal wires 4 of the cable 2. The wire connecting portions 10 are spaced apart on a pitch spacing correspondingly the same as the pitch spacing of the spaced apart signal wires 4. The signal wires 4 are cut to a common length, simultaneously overlaid upon the coplanar wire connecting portions 10 of the contacts 9 and are connected to the wire connecting portions 10 in one joining operation, for example, by welding or soldering. Wire connections of the signal wires 4 are formed by the joining operation.

With reference to FIGS. 3 and 4, a signal wire 4 and a tab 14 are connected to the same wire connecting portion 10 of a corresponding ground contact 9', and further are connected to each other by the joining operation. The signal wire 4 is placed to overlie both the tab 14 and the wire connecting portion 10 and is simultaneously connected thereto by the joining operation. Thereby, the signal wire 4 is selected to conduct the ground potential along the cable 2.

FIGS. 2, 3 and 4 disclose the ground wires 5 comprising shorter wires of the cable 2. The shorter, ground wires 5 extend to the wire connecting portions of the ground bus 7 located in a first plane. Further, FIGS. 2, 3 and 4 disclose the signal wires 4 comprising longer wires of the cable 2. The longer, signal wires 4 are spaced from the first plane and extend past the wire connecting portions of the bus 7 in the first plane, and extend to the wire connecting portions 10 of corresponding contacts 9. The wire connecting portions 10 of the contacts 9 are in a second plane.

Figure 5:
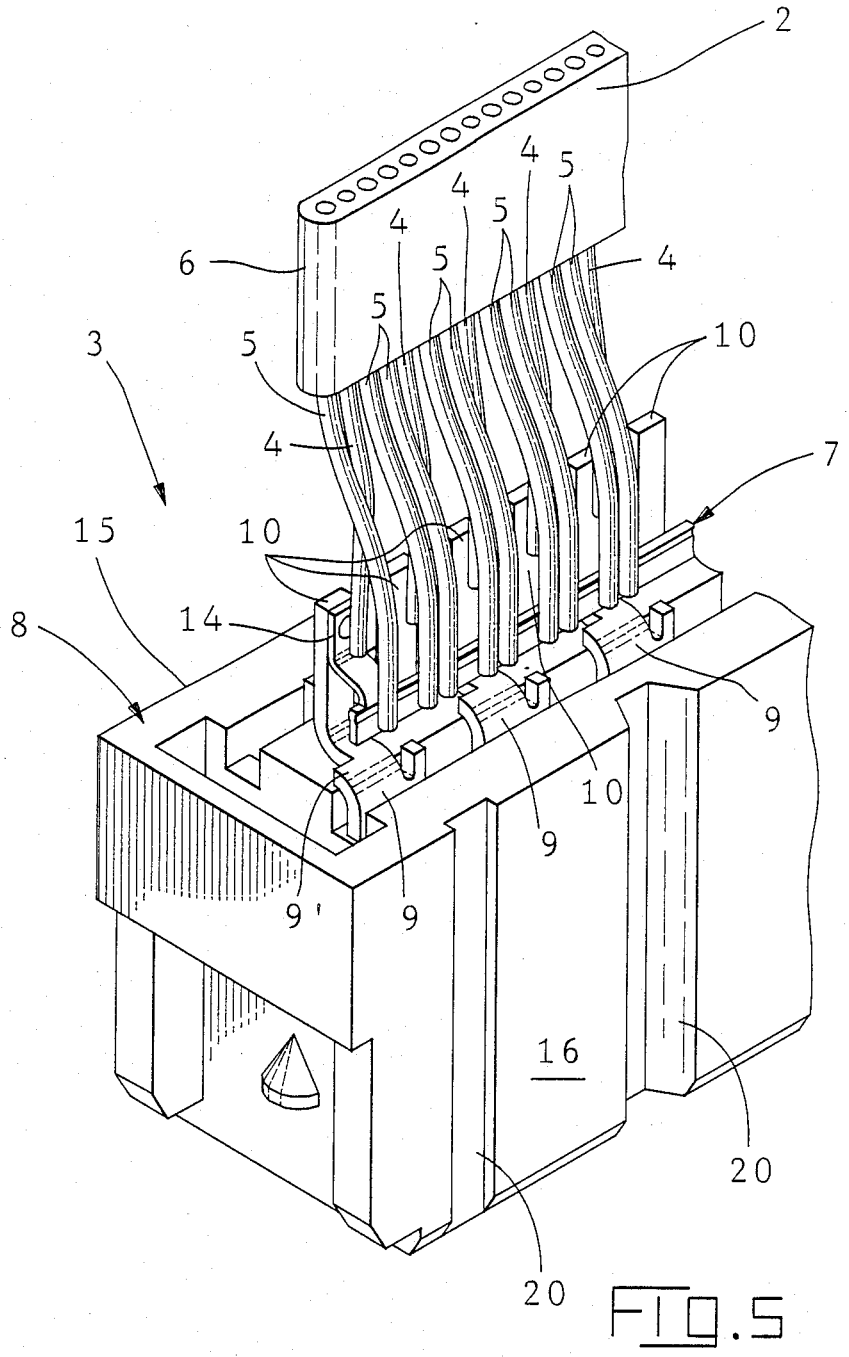
FIG. 5 is a view similar to FIG. 4 and illustrating another form of the connector assembly.
Figure 5:
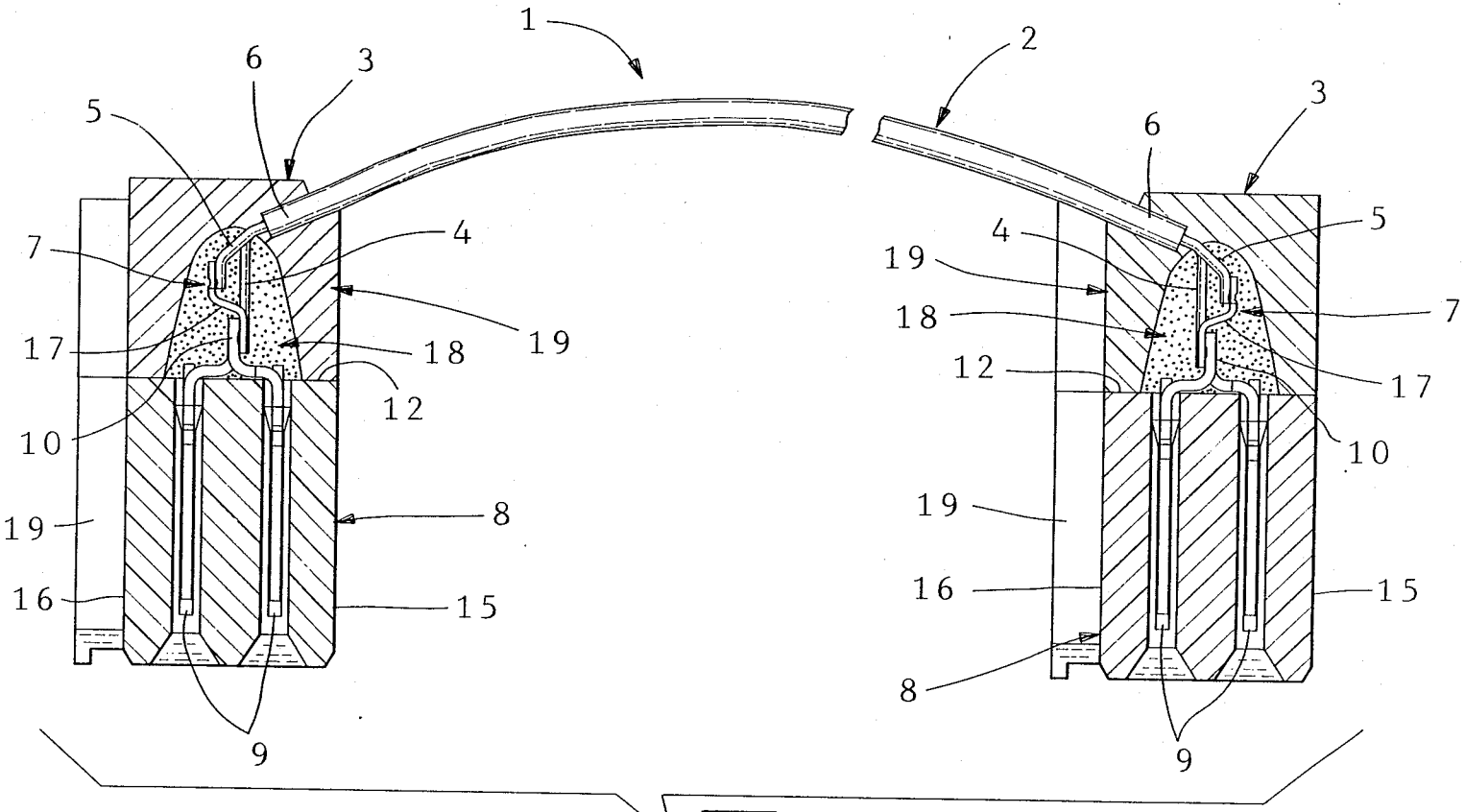

FIG. 5 discloses the ground wires 5 comprising longer wires of the cable 2, and the signal wires 4 comprising shorter wires of the cable 2. The shorter, signal wires 4 extend to the wire connecting portions 10 of the contacts 9. The wire connecting portions 10 of the contacts 9 are in first plane. The longer, ground wires 5 are spaced from the first plane and extend past the wire connecting portions 10 in the first plane, and extend to the wire connecting portions of the ground bus 7 in a second plane.

After the ground wires 5 are connected to the ground bus 7 of a connector assembly 3, and the signal wires 4 and the tabs 14 are connected to corresponding ground contacts 9' of the connector assembly, the wires 4,5 are extended from their wire connections to a cable entry side 15,16 of the corresponding connector assembly 3. The wires 4,5 are bent to extend toward the cable entry side 15,16.

With reference to FIG. 4, and as shown by the connector assembly 3 at the right side of FIG. 6, the longer wires 4 are bent such that the longer wires 4, extend from the wire connections 10 of the ground contacts 9' in the second plane and toward the cable entry side 16 without intersecting the first plane containing the wire connecting portions of the ground bus 7. Thereby the longer wires 4 avoid undesired contact with the wire connecting portions of the ground bus 7 to which the shorter ground wires 5 are connected. The longer wires 5, in FIG. 5, are bent such that the longer wires 5 extend from the wire connections of the ground bus 7 in the second plane and toward the cable entry side 16 without intersecting the first plane containing the wire connecting portions 10 of the contacts 9. Thereby, the longer wires 5 avoid undesired contact with the wire connecting portions 10, to which the shorter signal wires 4 are connected. Further thereby, the length of the connector assembly 3 from front to rear is shorter than if the longer wires 5 extend to the rear of the wire connecting portions 10 and cross over the wire connecting portions of the ground bus 7.

After the wires are extended to the cable entry side 15 or 16, fluid plastic material 18 is cast in place to fill spaces between the wires 4,5 and to cover the open ends of the cavities 11 at the rear end 13 of the plastic portion of the housing 8. Thereafter, the plastic material 18 is solidified to fix the wires 4,5 in place. Additional fluid plastic material 19 is cast in place, and covers and adheres to the wires 4,5, the rear end 13 of the plastic portion of the housing 8 and an embedded end portion of the cable 2 jacket 6. The additional plastic material 19 solidifies and retains the embedded portion 6 of the cable 2 at a location intersecting the cable entry side 15 or 16.

Industry requirements often specify that the cable assembly 1 shall have a versatile construction that permits the cable entry to intersect either of the sides 15,16 of the corresponding connector assembly 3. The cable entry of a connector assembly 3 on the right side of FIG. 6 intersects the first side 16 having the polarization structure, and the bus bar 7 is offset at 17 from the plane of the connecting portions 10 of the ground contacts 9' toward the second side 15. When the cable entry is desired to intersect the second side 15, as shown by the connector assembly 3 on the left side of FIG. 6, the ground bus 7 must be connected to the connecting portions 10 of the ground contacts 9' such that the ground bus 7 is offset at 17 to the first side 16, such that the longer wires 4 can extend from their wire connections to the cable entry at the second side 15 without crossing over the bus 7. A procedure for assembling the bus 7 is described above.

The plastic portion of the housing 8 includes a keying structure, for example, a projecting key 19 and recessed keyways 20,20 asymmetrically spaced along the side 16. The side 15 of the plastic portion is distinguished from the side 16 by the absence of the same keying structure. According to known practice, orientation of the connector assembly 3 is facilitated by using the keying structure as an orientation reference.

We claim:

1. In an electrical cable assembly of an electrical cable connected with an electrical connector assembly, the electrical connector assembly comprises, an insulative housing having opposite sides, conductive electrical contacts mounted to the housing and having corresponding wire connecting portions located in a corresponding plane for connection to corresponding signal wires of the cable, each of the wire connecting portions of the contacts having opposite sides facing toward corresponding opposite sides of the housing, a conductive ground bus having wire connecting portions in a corresponding plane for connection to corresponding ground wires of the cable, conductive tabs connecting the ground bus to one or more selected contacts, the cable having shorter wires connected to corresponding wire connecting portions in a first of the planes, the cable having longer wires that overlie the first of the planes and are connected to correspnding wire connecting portions in a second of the planes, and the cable projects outwardly of the housing to intersect a cable entry side of the housing that has been selected from one or the other of the sides of the housing, the improvement comprising;

when the longer wires of a corresponding electrical connector assembly are connected to the wire connecting portions of the ground bus, the ground bus is selectively connected by the tabs with selected sides of the wire connecting portions of corresponding contacts to project the ground bus in the second of the planes offset away from the first of the planes and toward the cable entry side, such that the longer wires are spaced away from the first of the planes and extend past the first of the planes and toward the cable entry side of the housing without intersecting the first of the planes, when the longer wires of a corresponding electrical connector assembly are connected to the wire connecting portions of the contacts, the ground bus is selectively connected by the tabs with selected sides of the wire connecting portions of corresponding contacts to project the ground bus in the first of the planes offset away from the second of the planes and away from the cable entry side, such that the longer wires are spaced away from the first of the planes and extend past the first of the planes and toward the cable entry side of the housing without intersecting the first of the planes, and insulative material of each electrical connector assembly covers the wire connecting portions and covers corresponding wires connected to the wire connecting portions.

2. In an electrical connector assembly as recited in claim 1, the improvement further comprising; the shorter wires are bent to extend from the corresponding wire connecting portions and toward the cable entry side.

3. In an electrical connector assembly as recited in claim 1, the improvement further comprising; the longer wires overlap the tabs and are connected to the tabs and the wire connecting portions of the contacts.

4. In an electrical connector assembly as recited in claim 1, the improvement further comprising; the wire connecting portions of the bus bar and of the contacts are spaced apart on the pitch of the wires.

5. In an electrical connector assembly as recited in claim 1, the improvement further comprising; the ground wires are of lengths in common and the signal wires are of lengths in common.

6. In an electrical connector assembly as recited in claim 1, the improvement further comprising; the wires are bent from their corresponding connections toward the cable entry.

7. A method for assembling an electrical cable assembly comprising the steps of;

selecting a cable entry to intersect a first side or a second side of a connector assembly, connecting a ground bus to selected electrical contacts with the ground bus offset from a plane of the contacts toward a side of the connector assembly opposite to the side to be intersected by the cable entry, connecting wire connecting portions of the contacts and wire connecting portions of the ground bus to corresponding signal wires and corresponding ground wires of an electrical cable, either the signal wires or the ground wires being longer wires of the cable, and extending the longer wires toward the cable entry side without intersecting the longer wires with a plane of the wire connecting portions connected to the shorter wires.

8. A method as recited in claim 7, and further including the step of; encircling each of the wires with insulative material and retaining a portion of the cable at the cable entry with insulative material.

9. A method as recited in claim 7, and further including the step of; bending the wires to extend the wires from the corresponding wire connecting portions toward the cable entry.

* * * * *